United States Patent [19]

Kishino et al.

[11] Patent Number: 4,633,134

[45] Date of Patent: Dec. 30, 1986

[54] COLOR FLUORESCENT DISPLAY DEVICE HAVING ANODE CONDUCTORS IN ZIG-ZAG PATTERN

[75] Inventors: Takao Kishino; Tadashi Mizohata, both of Mobara, Japan

[73] Assignee: Futaba Denshi Kogyo Kabushiki Kaisha, Mobara, Japan

[21] Appl. No.: 651,708

[22] Filed: Sep. 18, 1984

[30] Foreign Application Priority Data

Sep. 22, 1983 [JP] Japan ..... 58-174160

[51] Int. Cl.[4] ..... H01J 31/20

[52] U.S. Cl. ..... 313/497

[58] Field of Search ..... 313/496, 494, 517, 519, 313/585, 587, 497

[56] References Cited

U.S. PATENT DOCUMENTS 3,886,395 5/1975 Eukushima et al. ..... 313/585 X

FOREIGN PATENT DOCUMENTS 56-112055 9/1981 Japan ..... 313/496

56-134459 10/1981 Japan ..... 313/497

*Primary Examiner*—Palmer C. DeMeo

*Assistant Examiner*—Sandra L. O'Shea

*Attorney, Agent, or Firm*—Oblon, Fisher, Spivak, McClelland, & Maier

[57] ABSTRACT

A color fluorescent display device capable of attaining the high densification of display and the improvement of luminance and providing display with a good tone, including a plurality of control electrodes arranged in parallel in the column direction, anode conductors arranged in zig-zags and opposite to each of the control electodes, wiring conductors each connecting the anode conductors in the same row together and phosphors of green, red and blue luminous colors respectively deposited on the anode conductors in a descending order and in a repeated manner.

7 Claims, 11 Drawing Figures

COLOR FLUORESCENT DISPLAY DEVICE HAVING ANODE CONDUCTORS IN ZIG-ZAG PATTERN

BACKGROUND OF THE INVENTION

1. Field of the Invention

This invention relates to a color fluorescent display device, and more particularly to a color fluorescent display device particularly suitable for use in color graphic display.

2. Description of the Prior Art

In general, color image display has been carried out by using a cathode ray tube (CRT). Unfortunately, the CRT fails to provide a miniaturized, lightweight and thin display device, because it is large-sized in itself. In order to obviate such a problem, it is highly desirable to develop a color fluorescent display device.

A color fluorescent display device which has been conventionally proposed is generally constructed in such a manner as shown in FIGS. 1 or 2. More particularly, a color fluorescent display device shown in FIG. 1 comprises a plurality of control electrodes $g_1$, $g_2$—arranged in parallel in the column direction, anode conductors $a_1$, $a_2$, $a_3$,—arranged along each of the control electrodes and opposite thereto, wiring conductors each connecting the anode conductors $a_1$, $a_1$,—in the same row together, and phosphors of red, green and blue luminous colors R, G and B respectively deposited on the anode conductors $a_1$, $a_2$, $a_3$,—in the same column in regular order and in a repeated manner.

The other conventional color fluorescent display device shown in FIG. 2 comprises a plurality of control electrodes $g_1$, $g_2$,—arranged in parallel in the row direction, anode conductors $a_1$, $a_2$, $a_3$,—arranged along each of the control electrodes $g_1$, $g_2$,—and opposite thereto, wiring conductors C each connecting the anode conductors $a_1$, $a_1$,—in the same column together, and phosphors of red, green and blue luminous colors R, G and B respectively deposited on the anode conductors in the same row in regular order and in a repeated manner.

However, the conventional color fluorescent display devices each have the following disadvantages.

The mesh-like control electrodes $g_1$, $g_2$ each are supported at the four sides thereof by a rectangular frame (not shown), a gap is defined between the adjacent frames so as to electrically isolate the frames from each other, and the adjacent control electrodes $g_n$, $g_{n+1}$ are arranged side by side at a fixed interval. Accordingly, the control electrodes $g_1$, $g_2$,—must be substantially reduced in width l, because the size of the fluorescent display device is limited. This not only fails in the high densification of display but also substantially reduces an area of each of the control electrodes $g_1$, $g_2$,—effective to control electrons to cause the decrease in the number of electrons impinging on the phosphors, to thereby fail to improve luminance of the display.

The phosphors of red, green and blue luminous colors R, G and B are deposited on the anode conductors $a_1$, $a_2$,—in a linear manner. Accordingly, luminous display by the combinations RG, GB and RB of the phosphors obtained by selecting any two of the phosphors in one picture cell or the combination RGB causes the luminous interval to be varied to adversely affect the tone of display. This requires a correction of the tone, the correction having been conventionally carried out by varying voltage to be applied to the phosphors R, G and B to vary the luminance of each of the phosphors.

SUMMARY OF THE INVENTION

The present invention has been made in view of the foregoing disadvantages of the prior art.

Accordingly, it is an object of the present invention to provide a color fluorescent display device which is capable of accomplishing the high densification of display.

It is another object of the present invention to provide a color fluorescent display device which is capable of significantly enlarging an effective area of each of control electrodes necessary to control electrons to improve the luminance.

It is a further object of the present invention to provide a color fluorescent display device which is capable of exhibiting display of a good tone by arranging segment anodes of one picture cell in a triangular shape to render the interval between the segment anodes substantially constant.

The objects set forth above can be effectively attained by a color fluorescent display device of the present invention which comprises a plurality of control electrodes arranged in parallel in the column direction and segment anodes which include anode conductors arranged in zig-zags and opposite to each of the control electrodes, wiring conductors each connecting the anode conductors in the same row together, and phosphors of red, green and blue luminous colors respectively deposited on the anode conductors in a descending order and in a repeated manner every three anode conductors.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENTS

Now, a color fluorescent display device according to the present invention will be described with reference to the accompanying drawings.

Figure 3:
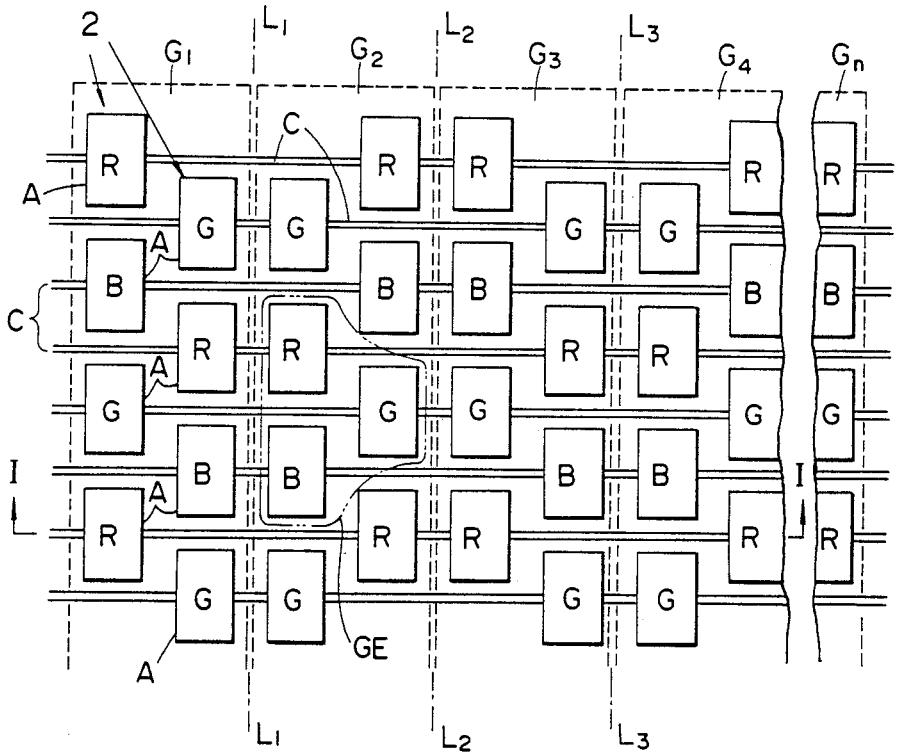
FIG. 3(A) is a schematic view showing the arrangement of electrodes in a first embodiment of a color fluorescent display device according to the present invention.
FIG. 3(B) is a sectional view taken along line I—I of FIG. 3(A)
FIG. 3(C) is a perspective view showing a segment anode in the first embodiment shown in FIGS. 3(A) and 3(B)
Figure 3:
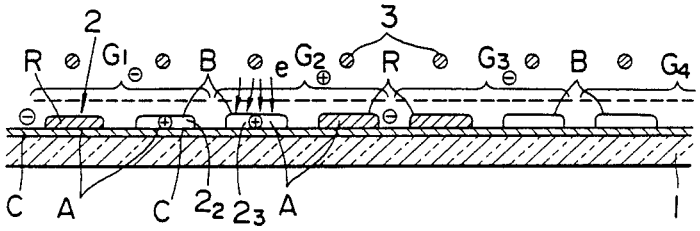
Figure 3:
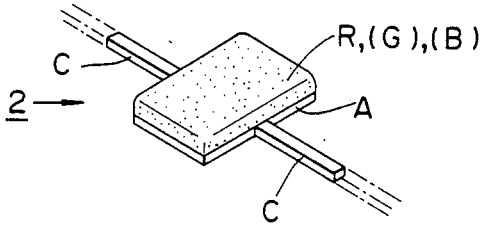

In FIGS. 3A and 3B, $G_1$–$G_n$ designate a predetermined number of control electrodes arranged in parallel in the column direction and opposite to a substrate 1. The substrate 1 has anode conductors A of a rectangular shape arranged thereon in zig-zags and opposite to each of the control electrodes $G_1$–$G_n$. The anode conductors A in the same row are connected together by a wiring conductor C.

The anode conductors A arranged in zig-zags and opposite to each of the control electrodes $G_1$–$G_n$ form a picture cell GE every three anode conductors in a descending order, and the three anode conductors of each picture cell have phosphor layers of red, green and blue luminous colors R, G and B respectively deposited thereon in regular order so that the anode conductor A, wiring conductor C and phosphor R (G or B) constitute one segment anode 2 as shown in FIG. 3C.

Thus, it will be noted that the phosphors on the anode conductors A on the same row are of the same luminous color. The anode conductors A in one column or opposite to each of the control electrodes $G_1$–$G_n$ are arranged in zig-zags to be symmetrical with those of the adjacent columns or adjacent control electrodes with respect to lines $L_1$—$L_1$, $L_2$—$L_2$, $L_3$—$L_3$,—in FIG. 3A. Further, the three segment anodes 2 constituting one picture cell GE are arranged to form a substantially triangular shape.

Like the above-described conventional color fluorescent display device, the device according to the present invention also includes at least one cathode and an evacuated envelope, not shown, surrounding the various electrodes.

Figure 1:
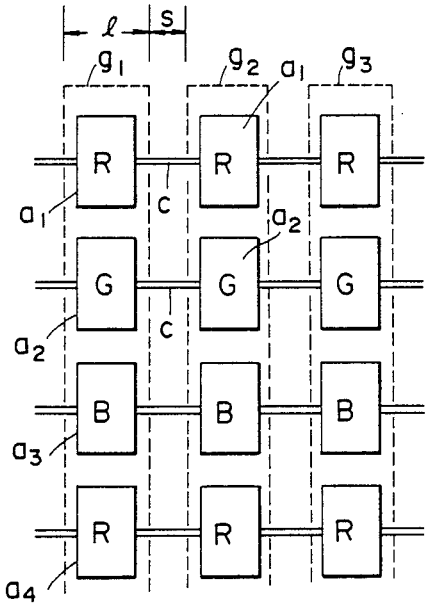
FIG. 1 is a schematic view showing the arrangement of electrodes in a conventional color fluorescent display device.
Figure 2:
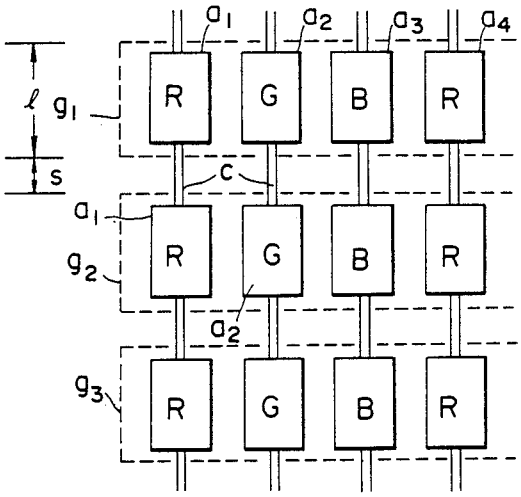
FIG. 2 is a schematic view showing the arrangement of electrodes in another conventional color fluorescent display device.

In the first embodiment as described above, the anode conductors A of each picture cell GE are arranged in zig-zags to form a substantially triangular shape, thus, each of the control electrodes is adapted to substantially control the segment anodes 2 in two lines. Both of the conventional color fluorescent display devices shown in FIGS. 1 and 2 include at least one cathode electrode and an evacuated envelope, not shown, surrounding the various electrodes. Accordingly, the color fluorescent display device of the embodiment causes the control electrodes to be substantially decreased in number as compared with the conventional one, resulting in the number of intervals between the adjacent control electrodes being significantly decreased. Also, in the above embodiment, the segment anodes 2 are densely arranged in the longitudinal direction of the control electrodes $G_1$–$G_n$, to thereby accomplish the high densification of display. Further, the decrease in number of control electrodes allows an effective area of each of the control electrodes $G_1$–$G_n$ necessary to control electrons to be enlarged so that the number of electrons emitted from a filamentary cathode and impinging on the segment anodes 2 may be significantly increased to improve luminance of the segment anodes 2.

Further, the three segment anodes 2 constituting one picture cell GE are arranged in a triangular shape at substantially equal intervals therebetween. Thus, the combinations RG, GB and RB of the phosphors resulting from selecting any two of the three phorphors in order carry out luminous display of a desired good tone as well as allows voltage of the same level to be applied to the respective segment anodes 2.

In the above embodiment, when, for example, the phosphor B on the segment anode $2_3$ in the third line opposite to the control electrode $G_2$ is subjected to positive potential to emit light, the control electrode $G_1$ is kept at negative potential. However, the phosphor B adjacent to the phosphor B emitting light and on the segment anode $2_2$ in the second line opposite to the control electrode $G_1$ has positive potential. This effectively prevents electric field from being disturbed, and electrons emitted from the cathode 3 are uniformly distributed over and impinge on the overall surface of the phosphor B on the segment anode $2_3$ in the third line to allow the phosphor B to accomplish good display without any display defect.

Figure 4A:
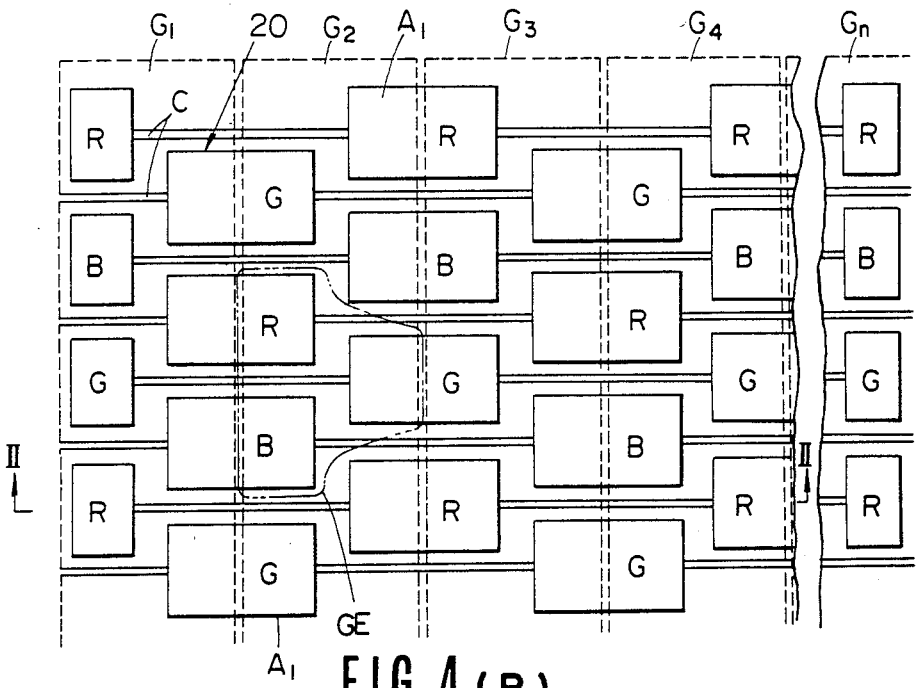
FIG. 4(A) is a schematic view showing the arrangement of electrodes in a second embodiment of a color fluorescent display device according to the present invention.
Figure 4B:
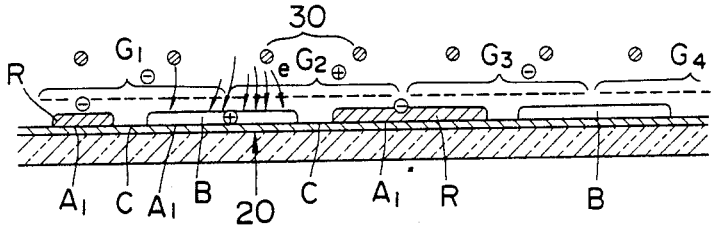
FIG. 4(B) is a sectional view taken along line II—II of FIG. 4(A)
Figure 4C:
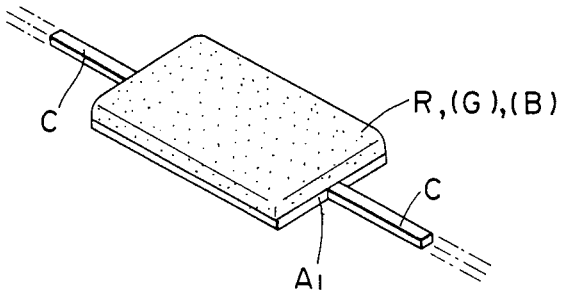
FIG. 4(C) is a perspective view showing a segment anode in the second embodiment shown in FIGS. 4(A) and 4(B)

A second embodiment of a color fluorescent display device according to the present invention is shown in FIGS. 4A-4C. The color fluorescent display device of the second embodiment is constructed in such a manner that two anode conductors A in the same row arranged opposite to adjacent control electrodes $G_1$–$G_n$ are integrally connected to one another to constitute one anode conductor $A_1$ and a phosphor R (G or B) is deposited on the overall surface of the anode conductor $A_1$.

In the second embodiment illustrated, segment anodes 20 constituting one picture cell GE are adapted to have a display area larger than that of the segment anodes in the first embodiment described above. Further, when it is desired to carry out display of, for example, the right half of the phosphor of the segment anode 20 in the second line opposite to the control electrode $G_2$ as shown in FIGS. 4A and 4B, the control electrode $G_1$ adjacent thereto is kept at negative potential, however, the left half of the segment anode 20 in the second line opposite to the control electrode $G_1$ is of course kept at the same positive potential as the right half. This allows electrons emitted from a cathode 30 to be distributed over and impinge on the whole surface of the phosphor B of the segment anode 20 stretching over both the control electrodes $G_1$ and $G_2$ irrespective of the adjacent control electrode $G_1$ having negative potential so that the right half of the phosphor B opposite to the control electrode $G_2$ may be allowed to have a large light-emission area to effectively prevent the display defect. In this instance, the voltage of the control electrode is preferably larger than that of the anode conductor, because this improves the light-emission efficiency.

The second embodiment shown in FIG. 4, as described above, is constructed in the manner that the anode conductors $A_1$ arranged at the positions opposite to the adjacent control electrodes and the phosphors R (G or B) deposited on the anode conductors are integrally formed, respectively. However, it may be modified in a manner such that the anode conductors $A_1$ at the positions opposite to the adjacent control electrodes are kept in a relationship separated from each other without being integrated with each other as in the first embodiment shown in FIG. 3, and only the phosphors R (G or B) deposited on the anode conductors $A_1$, $A_1$ are integrally formed in a manner to fill up a gap between the anode conductors as shown in FIG. 4. Such construction facilitates deposition of the phosphors as compared with the first embodiment while keeping a function of the second embodiment.

Figure 5A:
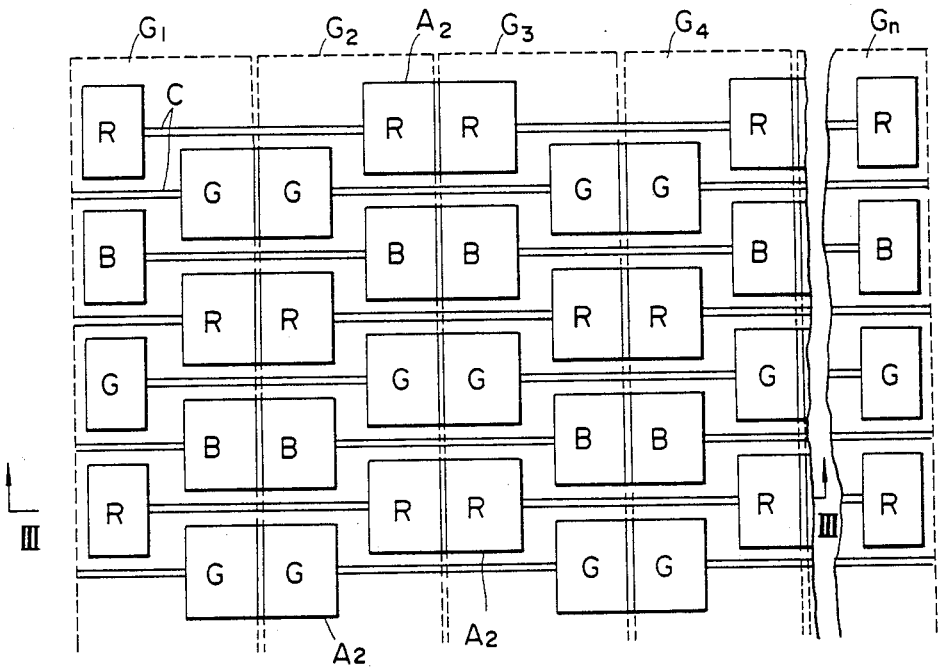
FIG. 5(A) is a schematic view showing the arrangement of electrodes in a third embodiment of a color fluorescent display device according to the present invention.
Figure 5B:
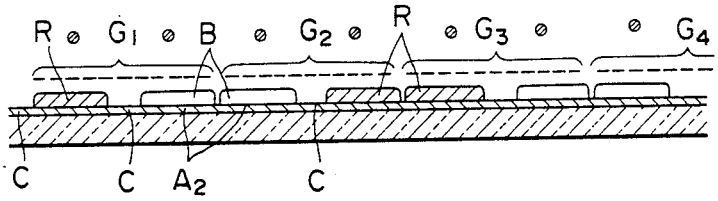
FIG. 5(B) is a sectional view taken along line III—III of FIG. 5(A)
Figure 5C:
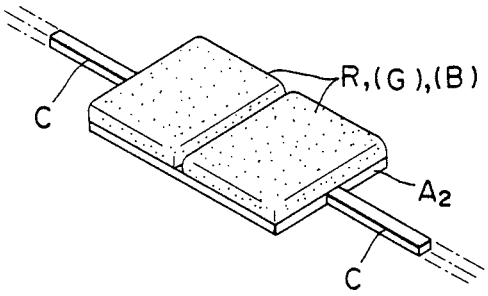
FIG. 5(C) is a perspective view showing a segment anode in the third embodiment shown in FIGS. 5(A) and 5(B).

Now, a third embodiment of a color fluorescent display device according to the present invention will be described with reference to FIGS. 5A, 5B and 5C.

In a color fluorescent display device of the third embodiment, anode conductors A in the same row opposite to adjacent control electrodes $G_1$–$G_n$ are integrally connected to form one anode conductor $A_2$ as in the second embodiment, and phosphors R (G or B) are deposited on only the portions of the anode conductor $A_2$ opposite to control electrodes $G_1$–$G_n$.

In the third embodiment, the gap between the adjacent phosphors R (G or B) corresponds to that between the adjacent control electrodes. The gap is narrow enough to ensure the substantially same display area as that in the second embodiment. Also, the anode conductor $A_2$ occupies an area just below the gap between the adjacent control electrodes, to thereby allow the phosphors to be deposited also on the areas of the anode conductors corresponding to the ends of the control electrodes $G_1$–$G_n$ so that light may be emitted from the whole surface of the phosphor having an area larger than that in the first embodiment.

In each of the embodiments described above, the anode conductor and wiring conductor may be formed using a one-layer wiring. Thus, the formation of the anode conductor and wiring conductor by a light permeable material provides a color fluorescent display device of the front emission type that light emission from phosphor is observed through a substrate.

The present invention may be constructed in such a manner that the anode conductors are arranged in zigzags and opposite to one control electrode in a manner to positionally correspond to the anode conductors arranged opposite to the adjacent control electrodes, respectively.

As can be seen from the foregoing, the color fluorescent display device of the present invention is constructed in the manner that a plurality of the control electrodes are arranged in parallel in zig-zags and opposite to each of the control electrodes, the wiring conductors each electrically connects the anode conductors in the same row together, and the phosphors of red, green and blue luminous colors are respectively deposited on the anode conductors in the descending order and in a repeated manner to form the segment anodes.

Thus, in the present invention, the segment anodes in two lines may be controlled together by one control electrode, because the anode conductors constituting each picture cell are arranged in zig-zags. Accordingly, the present invention may allow the control electrodes to be substantially decreased in number, resulting in the number of gaps between the adjacent control electrodes being decreased as compared with the conventional color fluorescent display device. This enables the high densification of display, because the segment electrodes can be densely arranged in the longitudinal direction of the control electrode.

Also, the present invention allows an effective area of each of the control electrodes necessary to control electrons to be significantly enlarged as well as permits the control electrodes to be decreased in number. Accordingly, electrons impinging upon the phosphor of each segment anode can be substantially increased to improve the luminance of the segment anode.

Further, the arrangement of the segment anodes constituting each picture cell in a triangular shape in the present invention permits the phosphors R, G and B to be disposed at equal intervals. Thus, luminous display based on the combinations RG, GB and RB of the phosphors obtained by selecting any two of the three phosphors does not cause the deterioration of tone which has been often encountered in the conventional color fluorescent display device, and the same voltage can be applied to the segment anodes.

Furthermore, in the present invention, the adjacent two anode segments in the same row are connected together by the common wiring conductor. This permits both the anode conductors to have positive potential and the adjacent control electrode of negative potential does not cause luminous display of the segment anode opposite to the control electrode of positive potential to have any display defect.

Still further, in the present invention, when the anode conductors in the same row arranged opposite to the control electrodes adjacent to each other are integrally connected, a display area is significantly enlarged to form display easy to be observed and the formation of the anode conductors is facilitated.

As many apparently widely different embodiments of this invention may be made without departing from the spirit and scope thereof, it is to be understood that the invention is not limited to the specific embodiment thereof except as defined in the appended claims.

What is claimed as new and desired to be secured by Letters Patent of the United States is:

1. A color fluorescent display device having plural electrodes including at least one cathode electrode mounted in an evacuated envelope, comprising:

a plurality of control electrodes arranged in parallel in a column direction opposite the cathode electrode; and segment anodes including anode conductors arranged opposite to each of said control electrodes, wherein each control electrode has the anode conductors opposite thereto arranged in zig-zags beneath the respective control electrode, wiring conductors each connecting said anode conductors in a same row together and phosphors of red, green and blue luminous colors respectively deposited on said anode conductors in a descending order and in a repeated manner every three anode conductors.

2. A color fluorescent display device as defined in claim 1, wherein the phosphors deposited on said anode conductors in the same row are of the same luminous color.

3. A color fluorescent display device as defined in claim 1, wherein the arrangement of the anode conductors in zig-zags and opposite to one control electrode is in a mirror image of to that of the anode conductors in zig-zags and opposite to the adjacent control electrodes.

4. A color fluorescent display device as defined in claim 1, wherein the anode conductors in the same row are integrally connected together at the position opposite to the respective adjacent control electrodes.

5. A color fluorescent display device as defined in claim 1, wherein said phosphors in the same row are integrally connected together at the position opposite to the respective control electrode.

6. A color fluorescent display device as defined in claim 1, wherein each three anode conductors arranged opposite to each of said control electrodes and adjacent to one another to form a triangular shape and having the phosphors of red, green and blue luminous colors respectively deposited thereon in order constitute one picture cell.

7. A color fluorescent display device as defined in claim 4, wherein said phorphors are deposited on only portions of said anode conductors opposite to each of said control electrodes.

* * * * *